US009359738B2

(12) United States Patent
Qi et al.

(10) Patent No.: US 9,359,738 B2
(45) Date of Patent: Jun. 7, 2016

(54) QUICK COUPLING FOR PIPE PILE

(71) Applicants: Guangzhou Institute of Building Science Co., Ltd., Guangzhou (CN); Technology Development Center of Guangzhou Institute of Building Science Co., Ltd., Guangzhou (CN)

(72) Inventors: Yuliang Qi, Guangzhou (CN); Mengxiong Tang, Guangzhou (CN); Hesong Hu, Guangzhou (CN)

(73) Assignees: Guangzhou Institute of Building Science Co., Ltd., Guangzhou (CN); Technology Development Center of Guangzhou Institute of Building Science Co., Ltd., Guangzhou (CN)

( * ) Notice: Subject to any disclaimer, the term of this patent is extended or adjusted under 35 U.S.C. 154(b) by 49 days.

(21) Appl. No.: 14/470,206

(22) Filed: Aug. 27, 2014

(65) Prior Publication Data

US 2015/0063923 A1 Mar. 5, 2015

(30) Foreign Application Priority Data

Aug. 28, 2013 (CN) ..... 2013 1 0382135

(51) Int. Cl.
*E02D 5/52* (2006.01)

(52) U.S. Cl.
CPC ..... *E02D 5/526* (2013.01)

(58) Field of Classification Search
USPC ..... 405/250, 252, 231, 232; 52/848, 849, 52/745.18, 745.17; 285/139.1, 142.1, 203, 285/208–210; 411/166, 169, 398
See application file for complete search history.

(56) References Cited

U.S. PATENT DOCUMENTS 973,470 A * 10/1910 Bogle ..... F16B 33/002 411/166
3,303,735 A * 2/1967 Fisher ..... F16B 5/02 411/400
3,714,786 A * 2/1973 Evans ..... E02B 11/005 404/4
4,074,500 A 2/1978 Bisutti
4,971,479 A * 11/1990 Byers, Sr. ..... E01F 9/011 173/129
5,687,537 A * 11/1997 Noble ..... H01Q 1/1242 403/337
6,471,457 B2 10/2002 Nago
2008/0063479 A1 3/2008 Stroyer

FOREIGN PATENT DOCUMENTS

JP 08260455 * 10/1996

* cited by examiner

*Primary Examiner* — Sean Andrish
(74) *Attorney, Agent, or Firm* — Muncy, Geissler, Olds & Lowe, P.C.

(57) ABSTRACT

The present invention relates to a quick coupling for pipe pile, comprising an upper end plate, a lower end plate and a screw hook made of spring steel for coupling the upper and lower end plate, a plurality of tapped holes are uniformly provided on the upper end plate, a plurality of holes corresponding to the tapped holes are provided on the lower end plate, a lock hole is positioned at the lower portion of the hole, while the cross-section area of the lock hole is bigger than the cross-section area of the hole. One end of the screw hook is provided with a screw end mating with the tapped hole on the upper end plate, while the other end is provided with a hook end mating with the lock hole on the lower end plate, whereby the upper and lower end plate can be coupled firmly.

10 Claims, 2 Drawing Sheets

QUICK COUPLING FOR PIPE PILE

FIELD OF TECHNOLOGY

The present invention relates to a technical field of pile foundation in the architecture engineering, specifically relates to a quick coupling for pipe pile.

BACKGROUND OF THE INVENTION

Single pipe pile is widely applied to the architecture engineering due to its high load-bearing capacity, well-adaptability to geological conditions having biggish varieties of the geological supporting layer, low cost, and fast construction. End plates of pipe pile are disposed at both ends of pipe pile and are the annular disk members made of metal. The end plates are mainly configured to stretch a reinforcement cage, and make the reinforcement cage generate a prestress during manufacturing process, while the end plate will be suffered from hit of the pile driver during pile-sinking process. Two adjacent pipe piles can be coupled firmly by the end plates. Generally, two prestressed concrete piles are coupled with each other by welding their couplings, for example, their end of plates, on site. However, the welding requires long time, namely approximate 30 minutes per coupling. Moreover, the welding quality will depend on the skill of worker. Sometimes the piles are driven into the earth immediately after the welding, the welding flaw will therefore unable to be found. A quenching cracking or water embrittlement on the couplings may occur when the couplings were driven into the earth and the couplings may therefore be damaged easily when they suffered the bias pressure due to varied geological conditions. In sampling test for the piles foundation, some unfirm or uncompleted welding have been found and caused that the capacities of bearing pressure, anti-bending, anti-shearing and resistant extraction at the coupling do not meet the designed requirement, and therefore supplementary welding is needed which wastes materials and delays the work process. Furthermore, when the coupling is being welded, its surface has a high temperature, thus an advanced antiseptic treatment for the coupling cannot be carried out, and the quality and lifetime of the coupling will be unsure.

A number of mechanical couplings used for pipe pile mainly comprise mechanical engagement coupling, mechanical flange coupling, mechanical fastening coupling and mechanical screw coupling, but there are certain flaws among them. For example, the mechanical engagement coupling has a complicated structure and high costs, in which a built-in clamping spring may easily be corroded and aged so that the spring loses its elastic property; The mechanical flange coupling, fastening coupling and screwed coupling all have an enlarged member, which virtually increase a resistance for the pile driving, and their coupling intensity may need to be improved.

SUMMARY OF THE INVENTION

Therefore, it would be desirable to provide a quick coupling for pipe pile to alleviate the above-mentioned drawbacks, since the quick coupling has simple structure, firm connection and easy rust-proof treatment.

In order to solve the above problems, this invention is achieved by the technical solution as followed:

A quick coupling for pipe pile according to the invention, configured to couple an upper pile to a lower pile, comprising an upper end plate positioned at a lower end surface of the upper pile, a lower end plate positioned at an upper end surface of the lower pile and a screw hook coupling the upper and lower piles, the upper and lower piles have identical cross-section to the cross-section of pipe pile, the upper end plate is fixed onto the lower end surface of the upper pile, and a plurality of tapped holes are uniformly provided on the upper end plate, the lower end plate is fixed onto the upper end surface of the lower pile, and a plurality of holes corresponding to the tapped holes are provided on the lower end plate; the screw hook has two ends, one end is a screw end mating with the tapped hole, while the other end is a hook end mating with the hole on the lower end plate, whereby the upper and lower end plate can be coupled firmly.

Furthermore, for convenient installation, an end surface of the hook end is arc-shaped.

Furthermore, both the main body and the screw end of the screw hook have a diameter of 5-30 mm.

Furthermore, in order to make the structure firm, said hook end has a length of 3-10 mm.

Furthermore, in order to facilitate the screw hook inserting into the hole, the openings of the hole on the lower end plate are oval-shaped.

Furthermore, in order to make the screw hook have firm lock function, an angle between the upper surface of the hook end and a longitudinal axis of the screw hook is less than 90 degrees.

Furthermore, each hole has an internal lock step inside the hole. The hole comprises an upper portion in the form of cylinder, to receive a main body of the screw hook, and a lower portion in the form of ellipsoid, to receive the hook end; the horizontal cross-section of the lower portion is bigger than that of the upper portion, whereby an internal lock step can be formed inside the hole, an angle between the internal lock step and the longitudinal axis of the screw hook is less than 90 degrees.

Furthermore, the screw hook is made of spring steel having good elasticity, in order to be installed easily.

Furthermore, in order to prevent corrosion matters in the ground from shortening the lifetime of the coupling of the present invention, the upper end plate, the lower end plate and the screw hook are provided with an electrogalvanizing layer on their surfaces.

Furthermore, the upper end plate, the lower end plate and the screw hook are provided with an asphalt paint layer over the electrogalvanizing layer, these two layers provide dual protection for the plates and the screw hook.

Compared to prior art, there are beneficial effects according to the invention as follows:

1. The invention brings out a quick coupling among the upper and the lower pipe piles, with high efficiency, as the invention should take 1-2 minutes to be completed while the present welding process needs approximate 30 minutes. The invention considerably reduces the use of pile foundation construction machine and hereby saves a construction cost.

2. The invention can work in all-weather condition, as it is an operation without any flame.

3. The invention can be operated easily, regardless of whether or not the operator must be a high-skilled person, and prevent more quality problems, e.g. slag inclusion and air vents in the welding line during welding process, or weld failure and pipe pile ends damage due to high temperature.

4. The invention has a considerable endurance in tough environments, as it can adopt corresponding antiseptic treatment thereon according to different geological conditions, for example, the parts of mechanical quick coupling can be configured as a dual protection, i.e. galvanizing treatment and asphalt paint, in order to resist a high level corrosion in the ground. But, in traditional welding process, the surface of the welding line has a relatively high temperature, which may easily damage an antiseptic coating. Thus, the advanced antiseptic treatment cannot be applied to metal parts. When the parts are cooled down, the ordinary coating will have poor antiseptic effect compared to hot galvanizing, fluorocarbon coating, etc.

5. Compared to traditional welded coupling, the present invention may considerably reduce material waste and the work period due to an apparent decrease in the rotted pile, broken pile and unqualified piles.

6. The present invention may be used together with traditional welding process, to ensure a coaxiality of the upper and lower piles to prevent mismatching. It also ensures the welding quality, and enhances the strength, the rigidity and the resistance to corrosion when welding the end plate of the coupling. Moreover, the present invention may add a reinforced welding layer to enhance the firmness, the anti-shearing and the anti-bending capacities of the coupling and convenience of inspection.

7. The present invention features a self-locking function without auxiliary members e.g. spring, pin and bolt. Compared to the conventional mechanical couplings in the art, the invention features simple structure and assembly, low cost, high strength of coupling, explicit load-bearing mechanism, short construction period and easy antiseptic treatment.

BRIEF DESCRIPTION OF THE DRAWINGS

The present invention will be further described in details hereinafter with the reference to accompanying drawings and exemplary embodiment, in which.

LIST OF REFERENCE CHARACTERS

1—upper end plate;
11—tapped holes;
2—lower end plate;
21—hole;
22—lock hole;
3—screw hook;
31—screw end;
32—hook end;

DETAILED EMBODIMENTS

The present invention will be further described in detail hereinafter with reference to accompanying drawings, with an example of a pile having a diameter of 400 mm. It should be understood that the preferred embodiments discussed herein are only for illustrating the present invention, but not to limit the invention.

Figure 1:
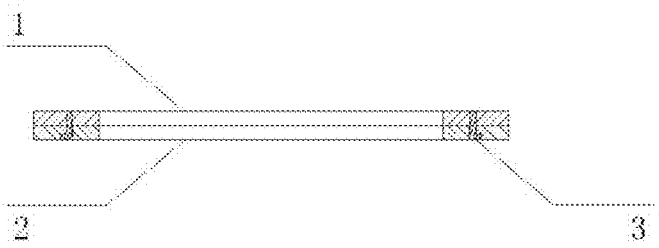
FIG. 1 is a cross-sectional view according to the present invention.
Figure 2:
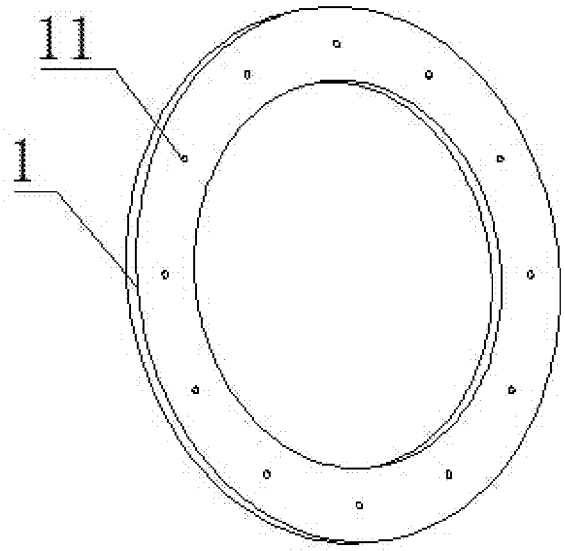
FIG. 2 is a structure schematic view of the upper end plate according to the present invention.
Figure 3:
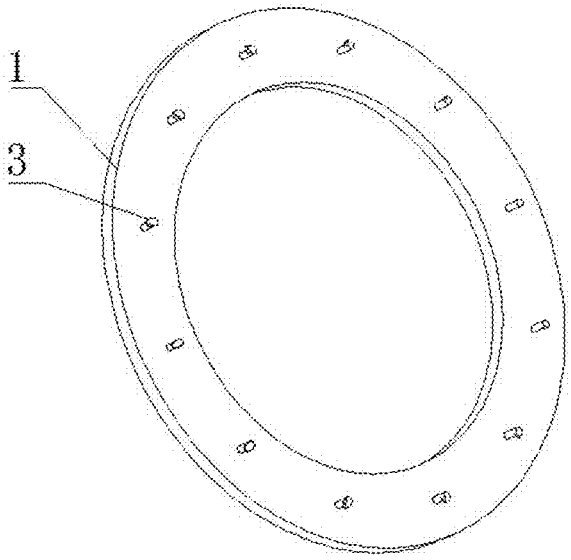
FIG. 3 is a structure schematic view of upper end plate while the screw hooks are mounted thereon according to the present invention.
Figure 4:
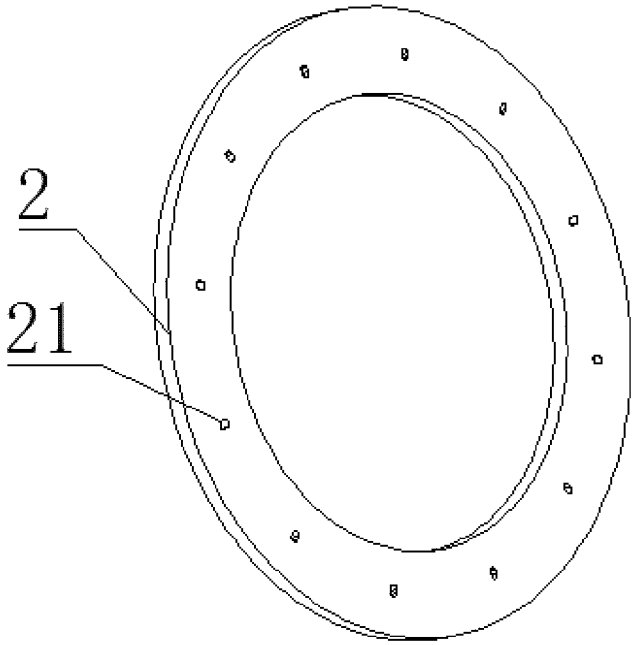
FIG. 4 is a structure schematic view of the lower end plate according to the present invention.
Figure 5:
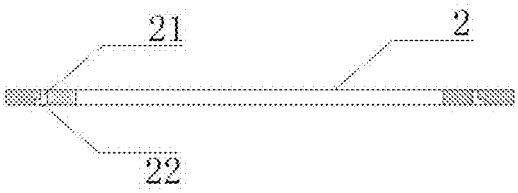
FIG. 5 is a cross-sectional view of the lower end plate according to the present invention.
Figure 6:
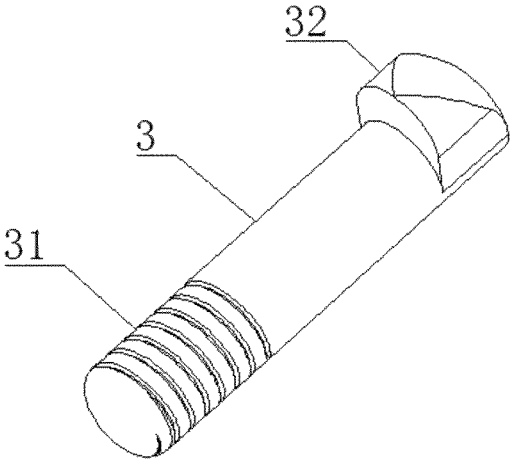
FIG. 6 is a structure schematic view of the screw hook according to the present invention.

As shown in FIG. 1-6, a quick coupling for pipe pile according to the present invention comprises an upper end plate 1, a lower end plate 2 and a screw hook 3 coupling the upper end plate 1 and the lower end plate 2.

In a preferred embodiment, two pipe piles, i.e. upper pile and lower pile, are in the form of hollow cylinder, and the upper end plate 1 and the lower end plate 2 are in the form of annulus, having identical cross-sections to the ones of the piles.

A plurality of tapped holes 11 are uniformly provided on the upper end plate 1, in this embodiment, there are twelve tapped holes 11 on it (but it is not limited to twelve holes, preferably at least six holes), the holes 21 corresponding to the tapped holes 11 are provided on the lower end plate 2. Each hole 21 consists of two portions, i.e. upper portion and lower portion, in which the upper portion is in the form of cylinder, to receive the main body of the screw hood, while the lower portion is in the form of ellipsoid, to receive the hook end; the horizontal cross-section of the lower portion is larger than that of the upper portion, whereby an internal lock step can be formed inside the hole 21, and the angle between the internal lock step and the longitudinal axis of the screw hook 3 is less than 90 degrees. Here the lower portion will also be named as lock hole 22. The screw hook 3 has two ends, in which one end is screw end 31, mating with the tapped holes 11 on the upper end plate 1, while the other end is the hook end 32 in which the end surface is configured as an arc such that the hook end 32 would be inserted into the hole 21 easily. The main body of the screw hook 3 and the screw end 31 have a diameter of 5-30 mm, and the hook end 32 has a length of 3-10 mm. The hook end 32 is in the form of ellipsoid, and the cross-section of the hook end 32 is larger than that of the main body of the screw hook 3. An angle between the upper surface of the hook end 32 and the longitudinal axis of the screw hook 3 is less than 90 degrees, preferably 80-90 degrees.

The screw hook 3 is made of spring steel having an excellent anti-elasticity-letdown performance, which is of a good elasticity, a high yielding limit, a high ultimate strength, a high fatigue strength and excellent anti-elasticity-letdown capacity. It has a stable property and good adaptability, which can be operated under hostile conditions. Since the horizontal cross-section of the lower portion of the hole 21 is larger than that of its upper portion, thus the hole 21 has an internal lock step inside formed by the lower and upper portions, and the internal lock step will contact with the hook end 32 when the screw hook 3 is inserted into the hole 21 completely, as the angle between the hook end 32 and the longitudinal axis of the screw hook 3 is less than 90 degrees, so that the internal lock step can bear a part of shearing force acting on the screw hook 3 from the lower end plate 2, so as to reduce the shearing fatigue load to the screw hook 3.

The surfaces of the upper end plate 1, the lower end plate 2 and the screw hook 3 will coated with an electrogalvanizing layer and an asphalt paint layer, which will be the dual protection for them, and prevent corrosion matters in the ground from shortening their lifetime.

The work principle of the present invention is as follows:

The screw hooks 3 are secured to the tapped holes 11 on the upper end plate 1, and then the hook ends of the screw hooks 3 are inserted into the holes 21 on the lower end plate 2. In general, the screw hooks 3 can be pressed into the holes 21 by the upper pile due to the pile's weight. As the screw hook 3 is made of spring steel having a good elasticity, the hook ends 32 can slide into the lock holes 22 through the holes 21 even if the hook ends 32 is slightly bigger than the holes 21, the hook ends 32 are then mated with the lock holes 22, whereby the upper end plate 1 and the lower end plate 2 can be coupled firmly by the screw hook 3. The present invention features simple structure and convenient installation, and improves the work efficiency, meanwhile it is convenient for performing an antiseptic treatment, and enhances the work quality, as well as shortens the work process and saves the cost.

The lower pile can be coupled to the upper pile which was positioned above the lower pile, before the lower pile has been driven into the ground completely. In the coupling process, a protective sleeve (not shown) may be used, having the inner diameter being equivalent to the diameter of the piles. For example, the protective sleeve may be sheathed and secured at the upper end of the lower pile by means of their interference fit, and the height of the sleeve wall above the lower pile is equivalent to the thickness of at least one lower end plate 2, such that the lower end plate 2 will be positioned and secured in the space enclosed by the protective sleeve and the lower pile, preferably the lower end plate 2 can be welded to the protective sleeve to be fixed. Similar protective sleeve is also applied to the upper end plate 1. Compared to the mechanical flange coupling in the prior art, the outer diameter of the protective sleeve is much less than the diameter of a flange, and will reduces a resistance during driving pile. This configuration can ensure that the ground foundation compresses tightly on the surface of the piles, and provides a tight foundation structure.

Considering the load-bearing condition of the prestressed concrete piles, the quick coupling may firstly meet the requirement of designed load-bearing capacity of the pile. The coupling members of the quick coupling can be calculated and analyzed in their stress-strain field based on the sample of the pile having a diameter of 400 mm, in which the main body/screw end of the screw hook have a diameter of 10 mm, and the hook end has a length of 5 mm. The finite element analysis ABAQUS can be adopted to research the material which may meet the requirements of anti-tensile capacity, anti-shearing capacity and anti-pressure capacity of the quick coupling for pipe pile.

According to "end plate used in prestressed concrete piles by pre-tensioning method" (JC/T 947-2005), "prestressed concrete piles by pre-tensioning method" (GB 13476-2009), "carbon structural steel" (GB/T 700-2006), "spring steel" (GB/T 1222-2007) and the requirement of the research, the upper and lower end plate will be made of carbon structural steel Q235, the screw hook will be made of high-quality spring steel such as $60Si_2Mn$ or $60Si_2MnA$. The following table 1 shows the mechanical properties of these materials. In the embodiment, the screw hook is made of high-quality spring steel $60Si_2MnA$.

TABLE 1

| Name | Designation | Strength | | elongation | Elas- |
|---|---|---|---|---|---|
| | | Yielding strength σp/MPa | Tensile strength σb/MPa | rate after fracture δ (%) | ticity modulus E/GPa |
| Carbon structural steel | Q235 | 225 | 370~500 | 26 | 210 |
| High-quality spring steel | 60Si2Mn | 1180 | 1275 | 5 | 200 |
| | 60Si2MnA | 1375 | 1570 | 5 | 205 |

The result of finite element numerical simulation analysis for the quick coupling indicates that there are three kinds of mechanical states comprising tension, shearing force and pressure, that:

A) Result Analysis for the Quick Coupling Under Tension:

(1) The intersection of the screw hook's main body and the hook end (the transition area), as well as the outer edge of upper surface of the hook end bear the relative bigger Mises stress, and the corresponding major load-bearing position is the outer edge of the internal lock step in the lower end plate. These positions are major load-bearing positions of the quick coupling under tension, so that they should be emphasized in the analysis of internal force and reinforced. The strength at the positions should be enhanced when configuring the profile of the hook end.

(2) the screw hook is flexed under tension. Therefore, the biggest deformation amount occurs at the lower endpoint of the screw hook, which should be researched further in the design of the screw hook. In addition, the outer edge of the internal lock step also has a relative big deformation.

(3) When the coupling member, i.e. the screw hook, is under tension, the intersection of the upper surface of the hook end and the main body of the screw hook (the transition area) become the plastic area first. When the tension is further increased, a plastic yielding and a bending break may occur in these positions. Likewise, the outer edge of the internal lock hole is a weak position inside the lock hole 22, in which a plastic yielding break may easily occur under tension. It should be emphasized in the analysis during the design process.

(4) The outer edge of the upper surface of the hook end has a biggest contacting pressure, corresponding to the edge of the internal lock step, in which the contacting normal force is supplied when the coupling members are under tension.

B) Result Analysis for the Quick Coupling Under Shearing Force:

(1) The intersection of the screw hook's main body and the hook end (the transition area), as well as the middle part of the screw hook bear the relative bigger Mises stress, and are the major load-bearing positions when the coupling member, i.e. the screw hook, is under shearing force. Meanwhile the lower portion of the hole is the major load-bearing position when the coupling member is under shearing force. Moreover, the Mises stress on the holes in the right side of the lower end plate 2 is bigger than the mises stress on the holes in the left side thereof, which is caused by the direction of the shearing force.

(2) After the deformation field was magnified 20 times, it can be seen that a flexural deformation of the screw hook occurs under shearing force in the horizontal direction. Moreover, the outer edge of the internal lock hole also has a relative big deformation amount.

(3) The intersection of the upper surface of the hook end and the main body of the screw hook (the transition area) may easily become the plastic area when the coupling member is under shearing force, and then a plastic yielding and a bending break may occur. Likewise, the outer edge of the internal lock hole is a weak position in which a plastic yielding break may easily occur under tension. Therefore, it should be reinforced.

(4) The points below the middle part of the screw hook 3 bear a biggest pressure, and correspond to the upper points of the hole 21 bearing the biggest contacting normal force this position is the major load-bearing position when the coupling member is under shearing force.

C) Result Analysis for the Quick Coupling Under Pressure

When the lower end plate is acted by twice designed axis pressure-bearing capacity of the piles, there is no stress concentration, no stress yield point and no deformation on the lower end plate, the biggest contacting normal force is 7.59 kN.

In conclusion, the quick coupling for pipe pile made of materials in Table 1 can meet the criteria about the designed load-bearing capacity of the pile required by "prestressed concrete piles" (Collection of national architecture criteria design 10G409-2010), through three-dimensional finite element calculation for the axis under tension (381 kN), shearing force (276 kN) and pressure (3504 kN). Therefore, the coupling can be practical for actual project.

Other structures of the quick coupling for pipe pile in the embodiment may refer to prior art.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A quick coupling for pipe pile, comprising an upper end plate, a lower end plate and a screw hook coupling the upper and lower end plates; a plurality of tapped holes are uniformly provided on the upper end plate, and a plurality of holes corresponding to the tapped holes are provided on the lower end plate; the screw hook has two ends, one end is a screw end mating with one of the tapped holes on the upper end plate, while the other end is a hook end mating with the holes on the lower end plate;

the quick coupling configured to couple an upper pile and a lower pile, the upper end plate is fixed onto a lower end surface of the upper pile, the lower end plate is fixed onto the upper end surface of the lower pile, the upper end plate and the lower end plate have identical cross-sections to the cross-section of the piles, the screw end is secured to one of the tapped holes on the upper end plate, and then the hook end is inserted into one of the holes on the lower end plate, whereby the upper and lower end plates are coupled firmly; and each hole on the lower end plate has an internal lock step inside the hole.

2. The quick coupling for pipe pile according to claim 1, wherein an end surface of the hook end is arc-shaped.

3. The quick coupling for pipe pile according to claim 1, wherein a main body of the screw hook and the screw end have a diameter of 5-30 mm.

4. The quick coupling for pipe pile according to claim 1, wherein the hook end has a length of 3-10 mm.

5. The quick coupling for pipe pile according to claim 1, wherein openings of the holes on the lower end plate are oval-shaped.

6. The quick coupling for pipe pile according to claim 1, wherein an angle between an upper surface of the hook end and a longitudinal axis of the screw hook is less than 90 degrees.

7. The quick coupling for pipe pile according to claim 6, wherein each hole on the lower end plate consists of an upper portion and a lower portion, in which the upper portion is in the form of a cylinder, to receive a main body of the screw hook, while the lower portion is in the form of an ellipsoid, to receive the hook end; a horizontal cross-section of the lower portion is larger than a horizontal cross-section of the upper portion, whereby the angle between the internal lock step and the longitudinal axis of the screw hook is less than 90 degrees.

8. The quick coupling for pipe pile according to claim 1, wherein the screw hook is made of spring steel.

9. The quick coupling for pipe pile according to claim 1, wherein the upper end plate, the lower end plate and the screw hook are provided with an electrogalvanizing layer on each surface.

10. The quick coupling for pipe pile according to claim 9, wherein the upper end plate, the lower end plate and the screw hook are provided with an asphalt paint layer over the electrogalvanizing layer.

* * * * *